United States Patent [19]

Puzhailo et al.

[11] 4,014,529

[45] Mar. 29, 1977

[54] DEVICE FOR VACUUM-REFINING OF MOLTEN METAL

[76] Inventors: Leonid Petrovich Puzhailo, pereulok Kremenetsky, 5a, kv. 2; Vitaly Petrovich Polischuk, prospekt Vernadskogo, 85, kv. 122; Viktor Konstantinovich Pogorsky, ulitsa Poligraficheskaya, 24a, kv. 247, all of Kiev, U.S.S.R.

[22] Filed: Jan. 15, 1975

[21] Appl. No.: 541,143

[52] U.S. Cl. ..... 266/210; 266/237; 164/255

[51] Int. Cl.[2] ..... C21C 7/10

[58] Field of Search ..... 13/31; 75/49; 266/34 V, 266/208–211, 236–237; 164/61–65, 253–258, 266, 281

[56] References Cited

UNITED STATES PATENTS

| | | | |
|---|---|---|---|
| 2,893,860 | 7/1959 | Lorenz | 266/34 V X |
| 3,179,512 | 4/1965 | Olsson | 75/49 X |
| 3,728,108 | 4/1973 | Sifferlen et al. | 75/135 |

FOREIGN PATENTS OR APPLICATIONS

| | | | |
|---|---|---|---|
| 2,092,647 | 1/1972 | France | 75/49 |
| 1,166,229 | 3/1964 | Germany | 75/49 |

*Primary Examiner*—Roy Lake
*Assistant Examiner*—Paul A. Bell

[57] ABSTRACT

A device for vacuum-refining of molten metal, comprising a vacuum chamber and an electromagnetic pump with an annulus-section line to which metal feed and discharge pipe lines are connected. The latter is coupled with the central portion of the annulus-section line. For pouring vacuumed metal into a foundry mold provision is made for a metal pouring pipe line connected to the metal discharge pipe line. The device envisages a higher degree of metal refining to free it from harmful impurities and a possibility of pouring metal directly into foundry molds.

16 Claims, 5 Drawing Figures

II
II

DEVICE FOR VACUUM-REFINING OF MOLTEN METAL

BACKGROUND OF THE INVENTION

The present invention relates to device for the vacuum-refining of metal to free it from harmful gaseous and solid impurities.

Present-art devices for the vacuum-refining of molten metal comprise a vacuum chamber wherein a vessel with molten metal is placed. Such devices suffer from a low yield since only a surface metal layer is subjected to the vacuum treatment. Due to high hydrostatic molten-metal pressure the formation of gas bubbles at a considerable depth in the metal accommodated in the vessel is thermodynamically unfeasible.

Moreover, in the above device the temperature of metal diminishes substantially during the vacuuming period which makes necessary the additional heating of the metal to a higher temperature in the melting units prior to vacuum-refining. Vacuum treatment of considerable volumes of metal amounting to 100 – 200 *t* requires the use of high-capacity vacuum pumps which are complicated both in operation and maintenance. All this adds considerably to the cost of the vacuum-refining of molten metal. Operation of vacuum chambers of a high capacity adapted for vacuum-refining of metal having a high melting point poses a number of problems associated with the sealing and servicing of such chambers.

It is known that the rate of degassing of molten metal under a constant vacuum depends on the thickness of a metal layer to be vacuum-treated. Therefore the devices for vacuum-degassing of molten metal in the course of its circulation have been developed to intensify the vacuuming process. In such devices a vacuum chamber is fitted with metal feed and discharge pipe lines immersed into a vessel with molten metal. To effect the vacuum degassing of molten metal rarefaction is created within the vacuum chamber, with the molten metal filling as a result both the metal feed and discharge pipe lines. Metal circulation through the vacuum chamber is provided by blowing an inert gas into the metal feed pipe line. The above arrangement ensures higher quality of metal due to intensification of its vacuum treatment, metal degassing requiring thereby less time.

The use of inert gas for metal circulation presents a number of difficulties. The inert gas blown into a metal pipe line enters the vacuum chamber augmenting the residual pressure therein. This requires the use of more powerful vacuum pumps, decreases the yield of the degassing process and the temperature of molten metal owing to heat losses with the inert gas, this entailing additional expenditures for metal re-heating or preheating to higher temperatures before vacuum treatment.

Known in the art is a device for vacuum-refining of molten metal, wherein an electromagnetic pump is employed for feeding metal from a vessel into a vacuum chamber, the pump being set up on a metal feed pipe line. The device does not use inert gas for conveying molten metal, the result being an increased metal degassing degree and a higher yield.

However, this device also suffers from considerable losses of heat of the molten metal since the electromagnetic linear pumps fail to provide their compensation and the metal must be heated to a considerable degree prior to vacuum-refining. Moreover, when metals with a lowspecific gravity are subjected to vacuuming, the height of a static metal column offsetting a pressure gradient between the residual pressure in the vacuum chamber and atmospheric pressure above the metal surface in the vessel reaches a considerable value (4.3 m for aluminum) demands the use of such devices having large overall dimensions. This presents additional difficulties as far as their sealing and heating are concerned. In addition, the pouring of the vacuum-refined metal into moulds is conducted under normal atmospheric conditions, so that the metal becomes gas-contaminated again, this resulting in lower quality of ingots being cast.

Also known is a device for vacuum-refining of molten metal, comprising two electromagnetic pumps of which one is mounted on a metal feed and the other on a metal discharge pipe line. Such pumps are adapted to effect metal circulation through a vacuum chamber and to compensate for the static metal column offsetting a pressure gradient between the atmospheric pressure above the metal surface in the vessel and a residual pressure within the vacuum chamber.

The above pumps allow decreasing the overall dimensions of the device for vacuum-refining of molten metal. However, the use of two electromagnetic pumps complicates the design of the device for vacuum-refining of molten metal and diminishes its reliability in operation. In this case heat losses of metal during vacuum treatment cannot be compensated for in view of a rather low heat capacity of linear electromagnetic pumps.

Because of an ever growing amount of metal being cast and more stringent requirements to its quality, a need has arisen in the provision of devices of the type described providing a higher yield and a high degree of metal degassing.

The now-existing arrangements fail to satisfy all these requirements simultaneously.

However, a constant strive for devising continuous casting techniques for the production of castings and ingots requires the use of arrangements providing vacuum-refining of metal combined with simultaneous pouring of molten metal into foundry molds excluding any contact whatever between the degassed metal and air.

OBJECTS AND SUMMARY OF THE INVENTION

The main object of the present invention is to provide a device for the vacuum-refining of molten metal which would make it possible to enhance the degree of metal refining to free it from harmful impurities.

Another object of the invention is the provision of a device ensuring sealed pouring of vacuumed metal along metal pipe lines preventing the metal from being again contaminated with gas thus, ensuing an increase in its quality after vacuum treatment.

Still another object of this invention is to provide a reduction in the overall dimensions of the device and a simpler design thereof.

Yet another object of the invention is the provision of a device easy to service and operate.

Said and other objects of the invention are achieved in a device for vacuum-refining of molten metal, comprising a vacuum chamber and an electromagnetic pump disposed below the chamber to supply molten metal thereinto along a metal feed pipe line and to discharge it therefrom along a discharge pipe line, wherein, according to the invention, the electromagnetic pump has an annulus-section line communicating with the vacuum chamber and with the metal feed pipe line, said metal discharge pipe line being connected from below to the central portion of said annulus-section line.

The device for vacuum-refining of molten metal provided with the electromagnetic pump having an annulus-section line ensures a higher degree of metal degassing.

Intensification of the vaccum-refining of a metal stream is ensured due to a high turbulization thereof in the vacuum chamber under the effect of electromagnetic forces causing oscillations and heating of the metal under treatment.

The herein-proposed device is fitted with a metal pouring pipe line adapted to supply the vaccumed metal into foundry molds, said pipe line being connected to the discharge pipe line.

As a result, the vacuumed metal fed into foundry molds will not be again contaminated with gases. The metal pouring pipe line for feeding the vacuumed metal into a foundry mold can be furnished with a drive to displace its inlet end vertically with respect to the outlet end of the metal discharge pipe line, so as to vary the amount of metal poured into the foundry mold.

In a preferred embodiment the metal feed pipe line is connected to the side portion of the annulus-section line of the electromagnetic pump.

This allows offsetting the pressure of a molten metal column counter-balancing a pressure gradient between the residual pressure in the vacuum chamber and atmospheric pressure above the metal surface in the vessel by making use of a single electromagnetic pump. Moreover, it simplifies the design of the device, enhances its reliability in operation and decreases power consumption for the vacuuming process. The metal feed pipe line can be fitted with a built-up sleeve having a calibrated orifice. This makes it possible to introduce a prescribed amount of molten metal into the vacuum chamber.

In another embodiment the feed metal pipe line is suspended in the vacuum chamber by its top end near which holes for discharging metal must be made, with the metal feed pipe line running along the central portion of the annulus-section line and along the discharge pipe line.

This offers a reduction in heat losses during the passage of metal along the metal feed pipe line and makes the device more compact.

The device is furnished with a drive linked mechanically with the top end of the metal feed pipe line and adapted to move it vertically.

Thus, the amount of metal introduced into the vacuum chamber, the intensity of its degassing and its supply into the foundry mold can be adjusted.

In the case where the metal pouring pipe line is connected to the outlet end of the discharge pipe line along which the metal feed pipe line is running, the discharge pipe line is fitted with an opening for the introduction of the metal feed pipe line.

The inlet of the metal feed pipe line can be provided with a filter secured therein.

The filter would preclude the ingress of large-size scabs and solid nonmetallics into the vaccum chamber.

BRIEF DESCRIPTION OF THE DRAWINGS

The nature of the invention will be clear from the following detailed description of particular embodiments thereof, to be had in conjunction with the accompanying drawings, in which.

DETAILED DESCRIPTION OF THE PREFERRED EMBODIMENTS

Figures 1, 2, 5:
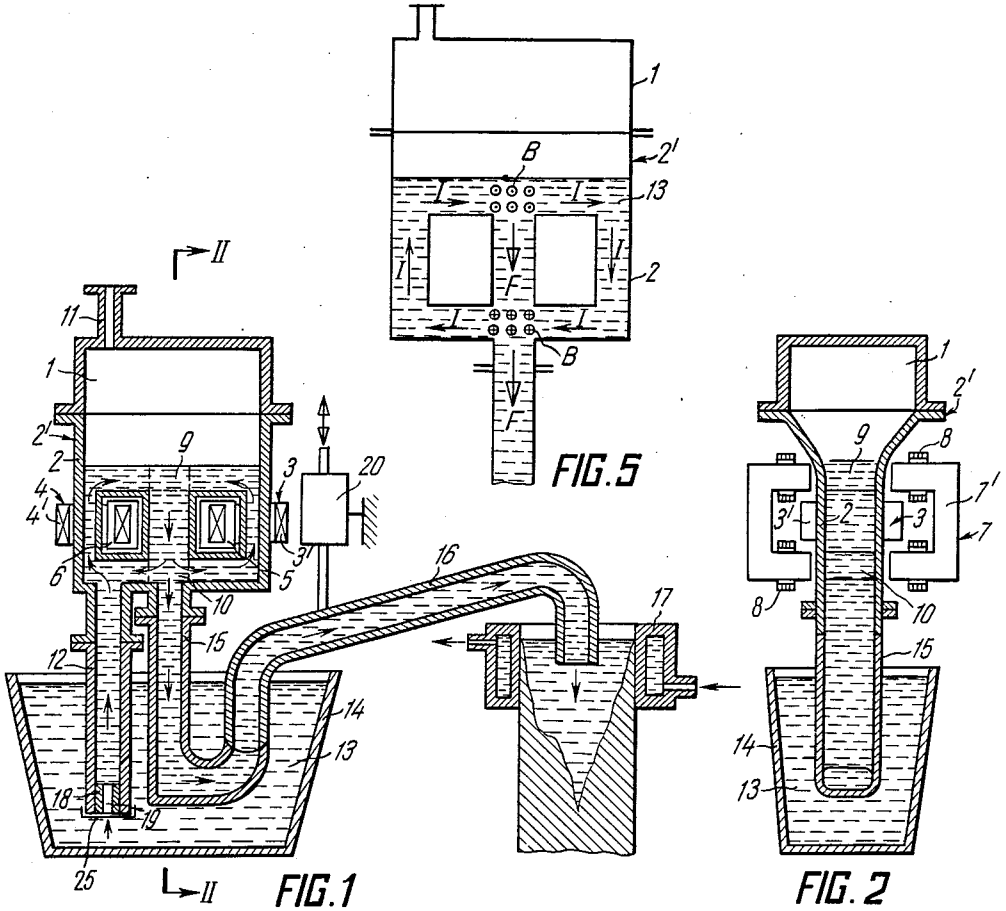
FIG. 1 shows a cross-sectional view of the inventive device wherein the metal feed pipe line is connected to the side portion of the annulus-section line.
FIG. 2 shows a cross-sectional view of the inventive device along section lines II — II of FIG. 1.
FIG. 5 is a schematic diagram illustrating the creation of the electromagnetic forces in the molten metal.
Figure 4:
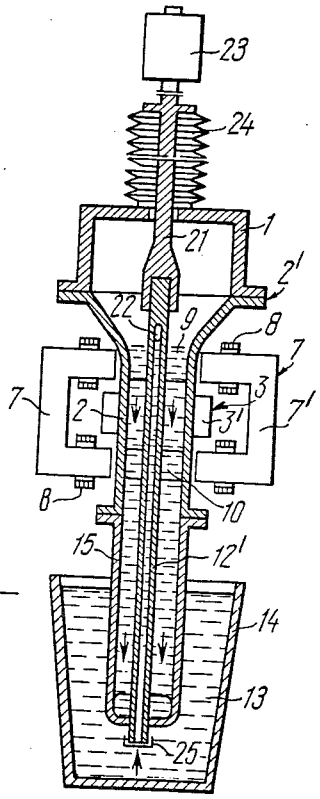
FIG. 4 shows a cross-sectional view of the inventive device along section lines IV — IV of FIG. 3.
Figure 3:
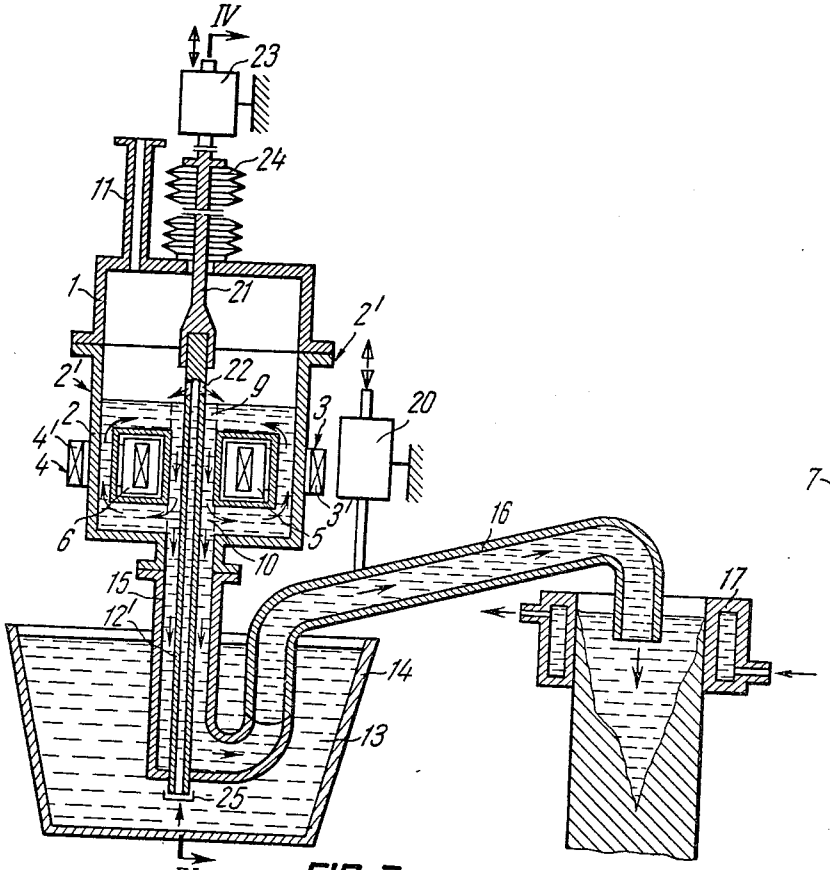
FIG. 3 shows a cross-sectional view of another embodiment of the device wherein the metal feed pipe line is accommodated in the discharge pipe line being suspended therein by its top end.

The present invention may have two embodiments of which one is illustrated in FIGS. 1 and 2 and the other in FIGS. 3 and 4.

The device has a vacuum chamber 1 (FIGS. 1 through 5) connected to an annulus-section line 2 of an electromagnetic pump 2′ (FIGS. 1 and 2) comprising two inductors 3 and 4 (FIG. 1) with closed magnetic circuits 3′ and 4′ and two electric coils 5 and 6 adapted to establish electric current I (FIG. 5) in metal being vacuumed, and an inductor 7 (FIG. 2) with an open magnetic circuit 7′ and electric coils 8 for establishing a magnetic field B (FIG. 5) in active zones 9 and 10 (FIGS. 1 and 2) of the electromagnetic pump 2′. The vacuum chamber is connected to a vacuum pump (not shown in the drawing) by means of a connecting pipe 11 (FIG. 1). A metal feed pipe line 12 adapted for supplying molten metal 13 from a vessel 14 into the annulus-section line 2 is connected to the side portion of the annulus-section line 2.

A metal discharge pipe line 15 connected to the central portion of the annulus-section line 2 is designed for discharging the vacuumed metal back into the vessel 14 or, provided it is joined with a metal pouring pipe line 16, into a foundry mould 17. The metal feed pipe line 12 is fitted with a sleeve 18 having a calibrated orifice 19. The metal pouring pipe line 16 is furnished with a drive 20 ensuring stepless joining of the pouring pipe line 16 and metal discharge pipe line 15.

To effect the vacuum-refining process the device is mounted on the vessel 14 so that the metal feed pipe line 12 and discharge pipe line 15 are immersed into the metal 13. Then the discharge pipe line 15 and pouring pipe lines 16 are disconnected with the help of the drive 20.

Next, rarefaction is created in the vacuum chamber 1 by means of a vacuum pump (not shown in the drawing) connected therewith through the connecting pipe 11. The molten metal 13 flows along the metal feed pipe line 12 and discharge pipe line 15 into the annulus-section line 2 and then into the vacuum chamber 1 under the effect of a pressure gradient between the residual pressure within the vacuum chamber 1 and atmospheric pressure above the metal 13 in the vessel 14. An annulus of molten metal is formed around the inductors 3 and 4 with closed magnetic circuits 3′ and 4′. After that voltage is fed to the electric coils 5 and 6.

This induces an electric current I (FIG. 5) in the molten-metal annulus. Following that voltage is fed to the electric coils 8 (FIG. 2) whereupon a magnetic field B is established in the gaps of the inductor 7 with an open magnetic circuit 7'. Owing to the interaction between the electric current I and magnetic field B electromagnetic forces F (FIG. 5) are established in the molten metal occupying the active zones 9 and 10 (FIGS. 1 and 2), said forces urging the metal 13 to flow along the metal discharge pipe line 15 (FIG. 1) into the vessel 14. A portion of the molten metal 13 proceeds from the active zone 10 into the side portions of the annulus-section line 2 and is directed back into the vacuum chamber 1. Under the effect of vacuum the molten metal 13 flows from the vessel 14 through the calibrated orifice 19 in the sleeve 18 along the metal feed pipe line 12 and side portion of the annulus-section line 2 into the vacuum chamber 1 where it is vacuumed under the effect of electromagnetic forces F (FIG. 5) developed in the active zones 9 and 10 (FIG. 1) and returns into the vessel 14 along the central portion of the annulus-section line 2 and discharge pipe line 15. Thus, metal circulation through the vacuum chamber 1 is effected. If the entire volume of the metal 13 accommodated in the vessel 14 is to be degassed it is passed through the vacuum chamber 1 repeatedly until a requisite degree of refining is attained. The amount of metal admitted into the vacuum chamber 1 is determined by the calibrated orifice 19 of the sleeve 18 whose cross-sectional area is dictated by a requisite intensity of the degassing process, parameters of the inductors of the electromagnetic pump 2', the size of the annulus-section line 2 and the distance from the level of the metal 13 within the vessel 14 to that in the vacuum chamber 1.

To accomplish the vacuum-refining process and to pour the metal into a foundry mold 17 a drive 20 joins the pouring pipe line 16 with the discharge pipe line 15. In this case the molten metal 13 proceeds from the vessel 14 through the calibrated orifice 19 along the metal feed pipe line 12 and side portion of the annulus-section line 2 into the vacuum chamber 1 where it is vacuumed and under the effect of electromagnetic forces F (FIG. 5) developed in the active zones 9 and 10 is delivered along the central portion of the annulus-section line 2, discharge pipe line 15 and metal pouring pipe line 16 into the foundry mold 17.

The amount of metal introduced into the foundry mold 17 is adjusted by changing the magnitude of an annular clearance between the metal discharge pipe line 15 and pouring pipe line 16. The speed of abutting of the discharge pipe line 15 and pouring pipe line 16 is dictated by the process requirements as to the requisite speed of metal supply into the foundry mold 17. The magnitude of the annular clearance betwen the metal discharge pipe line 15 and pouring pipe line 16 is calculated to fit the metal pressure developed in the active zones 9 and 10, hydraulic resistance of the discharge pipe line 15 and pouring pipe line 16 and the difference in metal levels in the vessel 14 and foundry mold 17, so that with the minimum clearance the amount of metal introduced into the foundry mold 17 will be a maximum one and with the maximum clearance the vacuumed metal will not be admitted into the foundry mold 17 at all.

To stop the supply of the vacuumed metal into the foundry mold 17 the drive 20 places the pouring pipe line 16 in its extreme upwards position which corresponds to a maximum clearance between the discharge pipe line 15 and pouring pipe line 16. In this case the vacuumed metal passes from the metal discharge pipe 15 back into the vessel 14. To discontinue the operation of the device the vacuum pump (not shown in the drawing) is shut off and the vacuum chamber is open to the atmosphere. As a result, the molten metal from the vacuum chamber 1, annulus-section line 2, discharge pipe line 15 and metal feed pipe line 12 runs off into the vessel 14. Next the electric coils 5, 6 and 8 are de-energized.

A device illustrated in FIGS. 3 and 4 comprises, similarly to the above-discussed, a vacuum chamber 1 communicating with the annulus-section line 2 of an electromagnetic pump 2' having two inductors 3 and 4 with closed magnetic circuits 3' and 4' and electric coils 5 and 6 adapted to establish electric current in the metal, and with an inductor 7 having an open magnetic circuit 7' and electric coils 8 designed to establish an electric field B (FIG. 5) in active zones 9 and 10 (FIGS. 3 and 4). The vacuum chamber 1 is connected to a vacuum pump (not shown in the drawing) through a connecting pipe 11. Unlike the above-described embodiment the metal feed pipe line 12' suspended by its top end from a rod 21 accommodated in the vacuum chamber 1 runs within the central portion of the annulus-section line 2 along the discharge pipe line 15 emerging therefrom through an opening in the bottom portion of the discharge pipe line 15. The metal feed pipe line 12' is fitted in its top portion with openings 22 through which the metal is admitted into the vacuum chamber 1. The metal feed pipe line 12' is made from an electrically nonconductive material and is furnished with a drive 23 adapted to move it vertically. Sealing of both the rod 21 and vacuum chamber 1 is effected by means of a bellows 24. The bottom end of the metal feed pipe line 12' has a filter 25 fastened to its inlet to preclude the entrappment of large-size scabs and solid nonmetallics together with the metal into the vacuum chamber.

The metal discharge pipe line 15 is connected to the central portion of the annulus-section line 2 and is fitted from below with a hole for the introduction of the metal feed pipe line 12'. A second (outlet) hole in the metal discharge pipe line 15 serves for connecting the pouring pipe line 16 thereto. The discharge pipe line 15 is adapted for supplying the vacuumed metal from the annulus-section line 2 back into the vessel 14 or foundry mold 17 along the abutting pouring pipe line 16.

On some occasions (not illustrated in the drawing), if the vacuumed metal is to be returned into the vessel, its supply into foundry molds being not envisaged at all, the outlet end of the metal feed pipe line 12' may be arranged coaxially with the outlet of the metal discharge pipe line.

However, the shape of the bottom end of the metal discharge pipe line 15 illustrated in FIGS. 3 and 4 is preferable. The pouring pipe line 16 has the drive 20 adapted for stepless joining of the pouring pipe line 16 and metal discharge pipe line 15.

To effect the vacuum refining process the device, according to the second embodiment, is placed on the vessel 14, so that the bottom end of the metal feed pipe line 12, and discharge pipe line 15 are submerged into the metal 13. Then the discharge pipe line 15 and pouring pipe line 16 are disconnected by the drive 20. Rarefaction is created in the vacuum chamber 1 by means of a vacuum pump (not shown in the drawing) connected through the connecting pipe 11. Under the effect of a pressure gradient between the residual pressure in the vacuum chamber 1 and atmospheric pressure above the metal 13 in the vessel 14 the molten metal 13 flows along the metal feed pipe line 12', discharge pipe line 15 and annulus-section line 2 into the vacuum chamber 1.

An annulus of molten metal is formed aroung the inductors 3 and 4 with closed magnetic circuits 3' and 4'. Then voltage is fed to the electric coils 5 and 6 and electric current is induced in the annulus of molten metal (FIG. 5). Next voltage is fed to the electric coils 8 (FIG. 4). A magnetic field B is established in the gaps of the inductor 7 with an open magnetic circuit 7' (FIG. 5). Owing to the interaction between the electric current I and magnetic field B electromagnetic forces F are developed in the molten metal occupying the active zones 9 and 10 (FIGS. 3 and 4), said forces urging the metal to flow along the metal discharge pipe line 15 (FIGS. 3 and 4) into the vessel 14. A portion of the molten metal proceeds from the active zone 10 into the side section of the annulus-section line 2 to be returned into the vacuum chamber 1. In this case under the effect of vacuum the molten metal 13 passes from the vessel 14 along the metal feed pipe line 12' through an opening 22 into the vacuum chamber 1 where it is sprayed in vacuum and freed from harmful admixtures. Following that under the effect of electromagnetic forces F (FIGS. 5) developed in the active zones 9 and 10 (FIGS. 3 and 4) the metal is conveyed along the central portion of the annulus-section line 2 and metal discharge pipe line 15 back into the vessel 14. Thus, metal circulation through the vacuum chamber 1 is accomplished. In case the entire volume of the metal 13 accommodated in the vessel 14 must be subjected to degassing, the metal 13 is passed repeatedly through the vacuum chamber 1 until a requisite refining degree is attained.

The amount of metal admitted into the vacuum chamber 1 is adjusted by displacing the metal feed pipe line 12' with the aid of a vertical displacement drive 23. If the metal feed pipe line 12' is arranged so that the opening 22 are disposed above the active zone 9, the amount of metal passing along the pipe line 12' will be a miximum one. If the metal feed pipe line 12' with the openings 22 is steplessly lowered from the top boundary of the active zone 9, the amount of metal supplied into the vacuum chamber 1 will diminish. When the metal feed pipe line 12' with the openings 22 is displaced downwards from the lower boundary of the active zone 9 to the upper boundary of the active zone 10, the amount of metal fed into the vacuum chamber 1 is kept constant, further displacement of the above pipe line 12' from the upper to the lower boundary of the active zone 10 resulting in the interruption in metal supply. Consequently, the amount of metal admitted into the vacuum chamber 1 and, hence, the intensity of the metal vacuum refining process in the vacuum chamber 1 can be adjusted by vertical displacement of the metal feed pipe line 12'.

In case metal vacuuming must be combined with the simultaneous pouring of the metal into the foundry mold 17, the pouring pipe line 16 is butted with the help of the drive 20 against the metal discharge pipe line 15. In this case the molten metal 13 will flow from the vessel 14 into the metal feed pipe line 12' and upon passing through the openings 22 it will be admitted into the vacuum chamber 1 where it is refined and freed from impurities. Under the effect of electromagnetic forces F (FIG. 5) established in the active zones 9 and 10 (FIGS. 3 and 4) it is conveyed along the central portion of the annulus-section line 2 into the metal discharge pipe line 15 and then into the pouring pipe line 16 and foundry mold 17. The amount of metal fed into the foundry mold 17 can be adjusted by using one of the following procedures: either by displacing the metal feed pipe line 12' (as outlined above) or by changing the magnitude of the annular clearance between the outlet end of the metal discharge pipe line 15 and the inlet end of the pouring pipe line 16. To stop the supply of the metal 13 into the foundry mold 17 the pouring pipe line 16 is shifted to a top extreme position. In this case it must be detached from the metal discharge pipe line 15. To discontinue the operation of the device the vacuum pump (not shown in the drawing) must be shut off and the vacuum chamber 1 is to be open to the atmosphere. Then the molten metal will run down from the pipe lines 2, 12' and 15 into the vessel 14. Following that the electric coils 5, 6 and 8 are de-energized.

The embodiment of the herein-proposed device, illustrated in FIGS. 3 and 4 is prefered when an adjustable supply of molten metal into the vacuum chamber is desired and when a high degree of metal refining is required to free it from harmful impurities.

The device for vacuum refining of molten metal, according to the invention, ensures metal vacuuming under most favourable degassing conditions — in a thin layer or in a stream. In this case under the effect of electromagnetic forces F (FIG. 5) established in active zones 9 and 10 (FIGS. 1, 2, 3 and 4) and of vortex metal flow in a vertical plane on both sides of the active zone 9 the metal flow in the vacuum chamber 1 is subjected to a high turbulence. Moreover, since the metal is supplied from the side portions of the annulus-section line 2 it can be passed repeatedly through the vacuum chamber 1 with the ensuing enhancement of its refining degree. The electromagnetic fields acting on the molten metal in the vacuum chamber 1 contribute to the removal of harmful impurities because of oscillations of the metal. All the above-listed considerations assist in producing metal with a very low content of harmful impurities.

With the rated metal supply into the vacuum chamber ensured owing to the throttling effect of the calibrated orifice (according to the first embodiment) or of the openings 22 (FIGS. 3 and 4) in the metal feed pipe line and by its displacement with respect to the active zones (according to the second embodiment of the proposed device), the use of an electromagnetic pump for discharging metal from the vacuum chamber allows offsetting the pressure of a static molten metal columm counterbalancing a pressure gradient between the atmospheric pressure and residual pressure in the vacuum chamber. Owing to this, a device designed for vacuum refining and pouring of metals having a low specific gravity (aluminum and its alloys) can have low overall dimensions, simple construction and provide easy servicing.

The use of an electromagnetic pump with inductors having closed magnetic circuits around an annulus of molten metal formed by the annulus-section line allows a highdensity electric current in the metal to be induced. During the passage of this current through the metal a large amount of heat is evolved, sufficient for offsetting the heat losses of the metal flowing through the device.

The proposed device can ensure additional heating of metal, if required, through which the melting process can be conducted at low temperatures and, hence, with a low contamination of metal with gases from the atmosphere. In this case pouring is effected at higher temperatures, as required by the casting or ingot production techniques. The supply of electric energy to the molten metal by inductors having closed magnetic circuits is effected with a high efficiency approaching that of a transformer, which diminishes the cost of power supply of the device.

An adjustable supply of vacuumed metal into foundry molds ensured by the device allows maintaining the level of molten metal in the mold automatically during both semicontinuous and continuous casting of ingots or metal proportioning when producing shaped castings by the chill, pressure or sand casting processes.

The supply of vacuumed metal into foundry molds along metal piping not communicating with the atmosphere precludes the contamination of the metal with atmosphere gases and ensures high quality of castings and ingots produced.

The device is made transportable and is adaptable for vacuum refining and pouring of metal from melting and metal-dispensing furnaces, mixers, bull ladles and similar units.

The device allows automating such labour-consuming operations as metal refining and pouring, promotes higher production rate and decreases the production cost.

The herein-proposed device ensures the production of high-quality metal, offers a reduction in casting rejects discarded because of gas pores and a non-acceptable level of nonmetallics and enables alleviation of sanitary conditions for attending personnel.

The device for vacuum refining of molten metal has successfully passed production tests which have displayed its high efficiency. The device was tested by refining aluminum-base alloys. The overall dimensions of the device were 800 × 800 × 1600 mm, the layer of metal in the vessel from which pouring was effected being 600 mm deep. Rarefaction in the vacuum chamber ranged from 1 to $1.10^{-2}$ mm Hg. Power input of the device varied from 15 to 20 kW. The production rate during pouring was adjusted in a 0.05 – 3 kg/s range. The device provided a decrease in metal hydrogen content from 0.8 to 0.04 $cm^3/100$ g. The tensile strength of the specimens cut from castings was greater by 20 – 30%, elongation by 2 – 3 times when compared with the castings produced by ladling without refining. In proportioning molten metal for producing castings from 1 to 10 kg in weight an accuracy of within 1 – 3% by weight was obtained.

What we claim is:

1. A device for vacuum-refining of molten metal, comprising: a vacuum chamber; an electromagnetic pump disposed under said vacuum chamber to feed metal thereinto; an annulus-section line of said electromagnetic pump composed of central and side portions and communicating with said vacuum chamber; a metal feed pipe line for feeding metal into said vacuum chamber, said metal feed pipe line communicating with said annulus-section line; a metal discharge pipe line for discharging metal from said vacuum chamber, said metal discharge pipe line being connected from below to the central portion of said annulus-section line of said electromagnetic pump; said electromagnetic pump further comprising two inductors, each having an electric coil and a closed magentic circuit embracing said side portion of said annulus-section line and a third inductor having electric coils with an open magnetic circuit of which the gaps are disposed in the areas of communication between said central portion and said side portions of said annulus-section line.

2. The device of claim 1, wherein said metal feed pipe line is fitted with a built-in sleeve having a calibrated orifice.

3. The device of claim 1, wherein the inlet of said metal feed pipe line is provided with a filter.

4. The device of claim 1, comprising a metal pouring pipe line for supplying vacuumed metal into a foundry mold said line being connected to said metal discharge pipe line.

5. The device of claim 4, wherein said pouring pipe line for supplying vacuumed metal into a foundry mold is furnished with a drive adapted fro vertical displacement of its inlet end with respect to the outlet end of the metal discharge pipe line thereby adjusting the amount of metal fed into the foundry mold.

6. A device for vacuum-refining of molten metal, comprising: a vacuum chamber; an electromagnetic pump disposed under said vacuum chamber to feed metal thereinto; an annulus-section line of said electromagnetic pump, composed of central and side portions and communicating with said vacuum chamber; a metal discharge pipe line for discharging metal from said vacuum chamber, said metal discharging pipe line being connected to the central portion of said annulus-section line; a metal feed pipe line for feeding metal into said vacuum chamber, secured therein by its top end near which the openings for discharging metal are disposed, said metal feed pipe line running along the central portion of said annulus-section line and said metal discharge pipe line.

7. A device of claim 6, having a vertical displacement drive linked mechanically with the top end of said metal feed pipe line.

8. A device of claim 6, comprising a pouring pipe line for supplying vacuumed metal into a foundry mould, said line being connected to the outlet end of said metal discharge pipe line, the latter being provided with an opening for the introduction of the bottom end of said metal feed pipe line.

9. A device of claim 8, wherein said pouring pipe line for supplying vacuumed metal into the foundry mould is furnished with a drive adapted for vertical displacement of its inlet end with respect to the outlet end of said discharge pipe line.

10. A device of claim 6, wherein the inlet of said metal feed pipe line is provided with a filter.

11. A device for vacuum-refining of molten metal, comprising: a vacuum chamber; an electromagnetic pump disposed under said vacuum chamber to feed metal thereinto; an annulus-section line of said electromagnetic pump composed of central and side portions and communicating with said vacuum chamber; a metal feed pipe line for feeding metal into said vacuum chamber, said metal feed pipe line communicating with said annulus-section line; a metal discharge pipe line for discharging metal from said vacuum chamber, said metal discharge pipe line being connected from below to the central portion of said annulus-section line of said electromagnetic pump; a metal-pouring pipe line for supplying vacuumed metal into a foundry mold, said metal pouring pipe line being connected with said metal discharge pipe line; and a drive connected to said metal-pouring pipe line adapted for vertical displacement of its inlet end with respect to the outlet end of the metal discharge pipe line thereby adjusting the amount of metal fed into said foundry mold.

12. The device of claim 11, wherein said metal feed pipe line is fitted with a built-in sleeve having a calibrated orifice.

13. The device of claim 11 wherein the inlet of said metal feed pipe line is provided with a filter.

14. A device for vacuum-refining of molten metal, comprising:

a vacuum chamber;

an electromagnetic pump disposed under said vacuum chamber to feed metal thereinto;

an annulus-section line of said electromagnetic pump composed of central and side portions and communicating with said vacuum chamber;

a metal feed pipe line for feeding said vacuum chamber, said metal feed pipe line being connected to the side portion of said annulus-section line;

a metal discharge pipe line for discharging metal from said vacuum chamber, said metal discharge pipe line being connected from below to the central portion of said annulus-section line of said electromagnetic pump;

a metal-pouring pipe line for supplying vacuumed metal into a foundry mold, said line being connected to said metal discharge pipe line;

wherein said metal-pouring pipe line for supplying said vacuumed metal into the foundry mold is furnished with a drive adapted for vertical displacement of its inlet and with respect to the outlet end of said metal discharge pipe line and for adjusting the amount of metal fed into the foundry mold.

15. The device of claim 14, wherein said metal feed pipe line is fitted with a built-in sleeve having a calibrated orifice.

16. The device of claim 14, wherein the inlet of said metal feed pipe line is provided with a filter.

* * * * *